United States Patent [19]

Kreissl et al.

[11] 4,235,499

[45] Nov. 25, 1980

[54] PLUG CONNECTION FOR CONTACT SUPPORTS

[75] Inventors: Gttmar Kreissl, Karlsfield; Manfred Nusselein, Hilden; Wolfgang Essrich, Haan, all of Fed. Rep. of Germany

[73] Assignees: Maschinenfabrik Augsburg-Nürnberg, Aktiengesellschaft, Munich; Souriau-Electric GmbH, Erkrath, both of Fed. Rep. of Germany

[21] Appl. No.: 927,147

[22] Filed: Jul. 21, 1978

[51] Int. Cl.[3] ..... H01R 13/62; H01R 13/50

[52] U.S. Cl. ..... 339/91 R; 339/186 R

[58] Field of Search ..... 339/75 R, 75 M, 75 MP, 339/88 R, 90 R, 197 B, 206 P, 91, 186 R

[56] References Cited

U.S. PATENT DOCUMENTS

| | | | |
|---|---|---|---|
| 3,133,777 | 5/1964 | Anhalt | 339/91 R |
| 3,560,908 | 2/1971 | Dell | 339/91 R |
| 3,605,070 | 9/1971 | Krafthefer | 339/91 R |

*Primary Examiner*—John McQuade
*Assistant Examiner*—John S. Brown
*Attorney, Agent, or Firm*—Scully, Scott, Murphy & Presser

[57] ABSTRACT

A plug connection for contact supports or contact holders which are constituted of an electrically insulating material, of which one is constructed hollow cylindrically-shaped and includes at least two longitudinal slots each provided with respectively one snap lock recess, and of which the second contact support is constructed so as to be guidedly insertable into the first one and which includes projections engaging into the longitudinal slots of the first contact support and which, in the final inserted position of the plug connection, lockingly engage into the associated snap lock recesses.

3 Claims, 3 Drawing Figures

PLUG CONNECTION FOR CONTACT SUPPORTS

BACKGROUND OF THE INVENTION

1. Field of the Invention

The present invention relates to a plug connection for interengaging electrical contact supports.

Plug connections of this type which are equipped with snap closures are commonly employed in households and plants for the connection of electrical appliances and lamps to a power supply connector. The plugs incorporate side metal brackets which concurrently serve as ground connectors, which engage within suitable recesses in the socket plug and thereby retain the plug in the contact position. Guide projections and complementary grooves assure that the plug can only be first inserted into the socket plug when the contact pins of the plug are located precisely opposite the contact apertures in the socket plug.

2. Discussion of the Prior Art

However, in the electrical technology, there are required plug connectors which are subjected to larger axial loads, respectively pulling loads, for which the known snap connector is not suitable. In this instance, one utilizes the assistance of bayonet or screw closures, however, these being quite complicated in their manufacture as well as in their manipulation.

SUMMARY OF THE INVENTION

Accordingly, it is an object of the present invention to provide an uncomplicatedly produced plug connector of the above-mentioned type which, while considering its simple manipulation, will afford a pull or tensile-secure connection of the contact supports.

The foregoing object is inventively attained through the intermediary of contact supports or contact holders which are constituted of an electrically insulating material, of which one is constructed hollow cylindrically-shaped and includes at least two longitudinal slots each provided with respectively one snap lock recess, and of which the second contact support is constructed so as to be guidedly insertable into the first one and which includes projections engaging into the longitudinal slots of the first contact support and which, in the final inserted position of the plug connection, lockingly engage into the associated snap lock recesses.

In this manner there is thus obtained an extremely simply producable plug connection interconnectable through mere pressure and which, further, is held together in its assembled end position secure against pulling through the locked-in projections. The cooperative effect of the projections and longitudinal slots serves concurrently as a guide and orientation aide during the formation of the connection.

The gap width of the longitudinal slots is slightly smaller than the diameter of the projections on the second contact support. Through the imparting of a predetermined pressure, the projections are introduced to such an extent, while the longitudinal slots are spread apart, until they engage into the snap lock recesses and the slots again close together into their initial position and thereby restrain the projections.

The contact pins may advantageously be directly encompassed within the material of the contact support. At an asymmetrical arrangement for the contact pins, the invention provides for an additional guide groove, having associated therewith a guide projection arranged on the opposite component. In this manner, the two contact supports can then only be inserted into each other when the guide elements are in alignment, so as to concurrently preclude a bending of the pin contacts upon insertion.

The contact support constructed pursuant to the invention may be presently produced in a single operative manufacturing step through casting or injection molding, wherein the grooves, projections, as well as a fastening flange for the socket plug and cable conductors in the plug, may concurrently be integrally formed therewith.

The pulling or tension securing may, in general, be considerably improved in that the cables which are connected with the plug are conducted within flat elongate grooves and are rigidly clamped therein through the intermediary of a cable connector or clamp.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
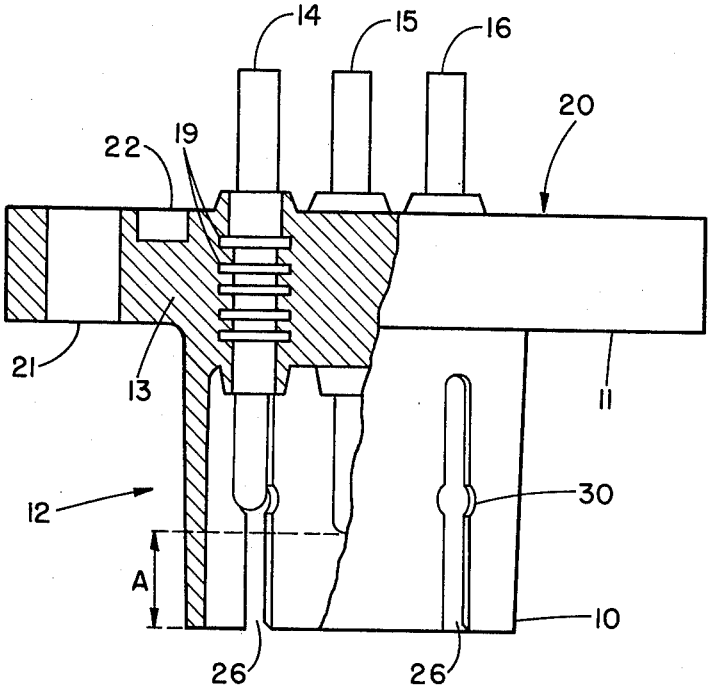
FIG. 1 is a longitudinal view, partly in section, of a socket plug according to the invention.

Illustrated in FIG. 1 is socket plug 12 having a cartridge-shaped component 10 and a flange 11. The flange 11, the cartridge 10 and the base 13 of the cartridge are unitary molded element from a thermoplastic material. Conducted through the base are contact pins 14 through 18 which incorporate labyrinths constructed as rings 19. The contact pins 14 through 18 are hermetically sealed into the base 13 due to the casting or injection molding process employed in the manufacture of the housing. By means of the labyrinth 19 there is extended the contact with the contact pins to such an extent between the two sides of the base 13, that there is also attained a highvacuum tightness. The labyrinth further has the advantage that the pins 14 through 18 are rigidly anchored in the housing base 13 and can be subjected to axial loading.

The socket plug 12, as illustrated in the drawing, is positioned at the upper side 20 of the flange 11 against a vacuum vessel, respectively a machine, and fastened to the vessel by means of fastening means such as, for example, screws leading through bores 21. The sealing is effected by means of a sealing ring (not shown) which is fitted into an annular groove 22.

Figure 2:
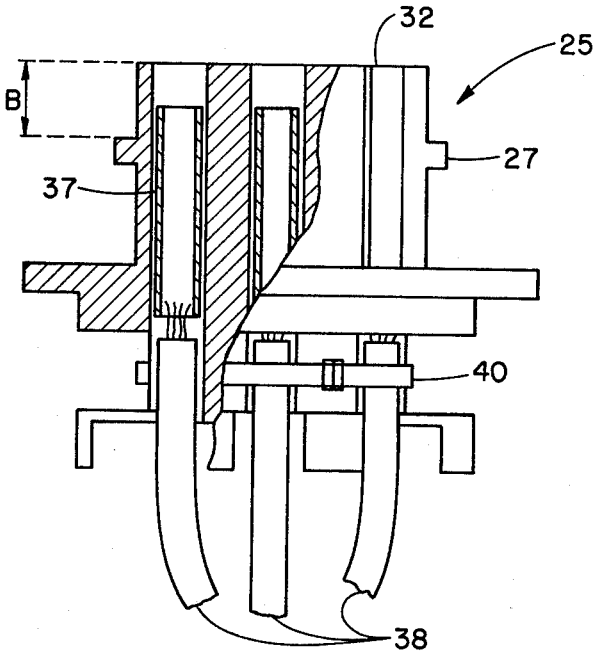
FIG. 2 is a partly sectioned view of a mating plug component.

The outwardly projecting cartridge-like component 10 of the socket plug serves for the receipt of a plug 25 as illustrated in FIG. 2 of the drawings. Provided in the cartridge 10 are two longitudinal slots 26, and on the plug 25 two which are formed as a unitary part of plug 25. For effecting the connection of the two contact members, under small widening of the longitudinal slots 26, the plug 25 is pressed into the socket plug 12 until the projections 27 engage in associated snap recesses 30 which are worked into the longitudinal slots. A connection of that type cannot be separated without a certain application of force which must be sufficient to be able to slightly widen the two cartridge halves. In addition thereto, this snap connection has the advantage that for a free end A of the cartridge 10 which is dimensioned longer in comparison with the distance B between the projections 27 and the end surface of the plug 25, it is possible to provide, for each situation, a dependable and secure matching between the two contact supports. For an orientation which does not coincide, the projections 27 are guided along the free edge of the cartridge 10, without producing the possibility that the end surface of the plug 25 will contact against one of the contact pins or bend the latter over.

Figure 3:
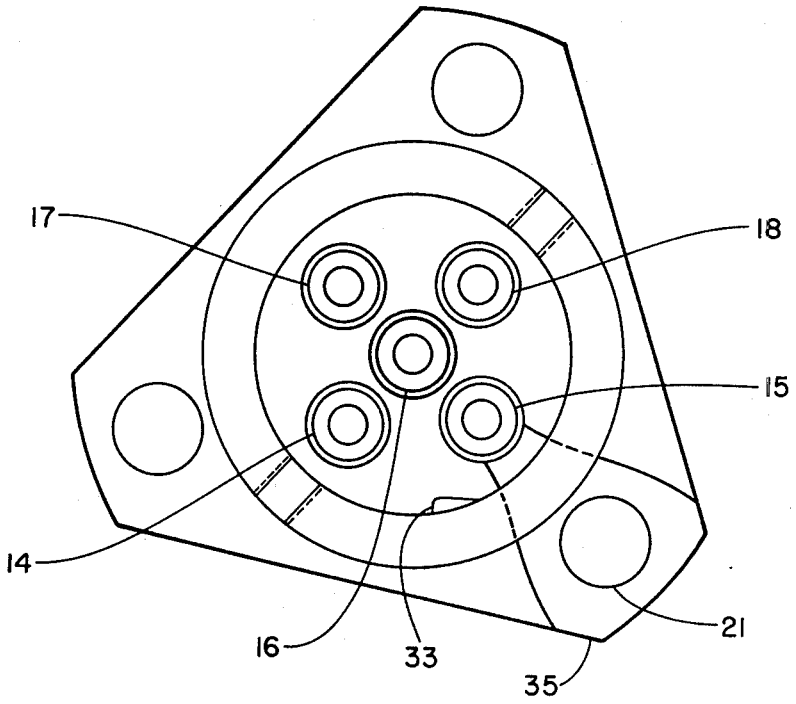
FIG. 3 is an end view of the socket plug.

For asymmetrically arranged contact pins 14 through 18, there is provided a guide groove 32 and on the mating component a guide projection 33 (FIGS. 2 and 3). In this manner there should be assured that the assembly of the contact pins with the pressure pins 37 of the plug 25 can only be effected when they are positioned precisely opposite each other. Hereby these contact retainers can be interconnected without difficulty and securely, and also when they are arranged on an apparatus so as not to be visually accessible. A further safety measure consists of in that the grounded contact pin 15 may be so advanced, meaning prior to the formation of a contact between a pin connected to power and other electrically conductive components, there is provided a connection to ground.

Finally, in order to create a further simplification for the assembly of the inventive plug, there is also provided a metal plate 35 which is incorporated in the form of the socket plug, which frames out a fastening bore 21 and is connected with the grounded contact pin 15. This will produce the connection to ground directly through the screw by means of which the socket plug is fastened to a receptacle, respectively motor, or another kind of arrangement.

For effectuating the securing of the connector cable 38 longitudinal grooves may be provided in the plug 25, in which the cable 38 is clamped by means of a cable connector 40. In this manner, the plug connection is also secured against pulling loads which are imparted to the cables 38.

What is claimed is:

1. Plug connection comprising interengaging electrical contact supports, said contact supports being constituted of an electrically insulating material; a first one of said contact supports being a unitary, hollow cylindrically-shaped body including at least two longitudinal slots through the unitary body, snap lock recesses being formed in each of said slots; and a second one of said contact supports being a unitary body shaped so as to be insertable into said first contact support and including projections on the unitary body engaging in said longitudinal slots of said first contact support, said projections snapping into respective ones of said snap lock recesses in the final inserted end position of said plug connection, and said longitudinal slots of said first contact support having a gap width slightly smaller than the external diameter of said projections on said second contact support which engage the longitudinal slots in said first contact support.

2. Plug connection as claimed in claim 1, one said contact support including a single guide groove, and the other said contact support including a single guide projection associated with said guide groove such that the contact supports are engageable with each other in only a single correct position.

3. Plug connection as claimed in claim 2, said first contact support being formed as a socket plug and including a fastening flange comprising a common component with said socket plug.

* * * * *